US009941627B2

(12) United States Patent
Esmaeili et al.

(10) Patent No.: US 9,941,627 B2
(45) Date of Patent: Apr. 10, 2018

(54) MAGNETIC SURFACE CONTACTS

(71) Applicant: APPLE INC., Cupertino, CA (US)

(72) Inventors: Hani Esmaeili, Sunnyvale, CA (US); Eric S. Jol, San Jose, CA (US); Ibuki Kamei, San Jose, CA (US); Daniel C. Wagman, Los Gatos, CA (US); Albert J. Golko, Saratgoa, CA (US); Mahmoud R. Amini, Sunnyvale, CA (US); Mani Razaghi Kashani, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/181,307

(22) Filed: Jun. 13, 2016

(65) Prior Publication Data

US 2017/0093087 A1 Mar. 30, 2017

Related U.S. Application Data

(60) Provisional application No. 62/235,326, filed on Sep. 30, 2015.

(51) Int. Cl.
*H01R 11/30* (2006.01)
*H01R 13/24* (2006.01)
(Continued)

(52) U.S. Cl.
CPC ..... *H01R 13/6205* (2013.01); *H01R 11/30* (2013.01); *H01R 12/61* (2013.01);
(Continued)

(58) Field of Classification Search
CPC ..... H01R 13/6205; H01R 13/24; H01R 13/2421; H01R 11/30
See application file for complete search history.

(56) References Cited

U.S. PATENT DOCUMENTS 6,213,783 B1 4/2001 Kankkunen
6,749,441 B1 * 6/2004 Ma ..... H01R 13/2435 439/259
(Continued)

FOREIGN PATENT DOCUMENTS

CN 102570166 7/2012
CN 202633647 12/2012
(Continued)

OTHER PUBLICATIONS

EP16185102.7 , "Extended European Search Report", dated Feb. 8, 2017, 6 pages.

*Primary Examiner* — Xuong Chung Trans
(74) *Attorney, Agent, or Firm* — Kilpatrick Townsend & Stockton LLP

(57) ABSTRACT

This application relates to magnetically actuated electrical connectors. The electrical connectors includes movable magnetic elements that move in response to an externally applied magnetic field. In some embodiments, the electrical connectors includes recessed contacts that move from a recessed position to an engaged position in response to an externally applied magnetic field associated with an electronic device to which the connector is designed to be coupled. In some embodiments, the external magnetic field has a particular polarity pattern configured to draw contacts associated with a matching polarity pattern out of the recessed position.

21 Claims, 14 Drawing Sheets

(51) Int. Cl.

| | |
|---|---|
| ***H01R 13/62*** | (2006.01) |
| ***H01R 12/61*** | (2011.01) |
| ***H01R 13/22*** | (2006.01) |
| ***H01R 13/52*** | (2006.01) |
| *H01R 13/193* | (2006.01) |

(52) U.S. Cl.
CPC ..... *H01R 13/22* (2013.01); *H01R 13/5213* (2013.01); *H01R 13/193* (2013.01); *H01R 13/24* (2013.01)

(56) References Cited

U.S. PATENT DOCUMENTS

| | | | | |
|---|---|---|---|---|
| 7,914,320 | B2 * | 3/2011 | Ko | H01R 13/502 439/490 |
| 8,133,071 | B2 * | 3/2012 | Huang | H01R 12/778 439/499 |
| 8,535,088 | B2 * | 9/2013 | Gao | H01R 9/03 439/39 |
| 8,740,630 | B2 * | 6/2014 | Fujino | G06F 1/1656 439/67 |
| 9,281,612 | B2 * | 3/2016 | Gao | H01R 9/03 |
| 9,300,081 | B2 * | 3/2016 | Rudisill | H01R 13/6205 |
| 2008/0132090 | A1 | 6/2008 | Bozzone et al. | |
| 2014/0287601 | A1 | 9/2014 | Suh | |

FOREIGN PATENT DOCUMENTS

| | | |
|---|---|---|
| CN | 204633034 | 9/2015 |
| EP | 0867977 | 2/2017 |

* cited by examiner

*C-C*

MAGNETIC SURFACE CONTACTS

CROSS-REFERENCE TO RELATED APPLICATIONS

This application claims priority under 35 USC 119(e) to U.S. Provisional Patent Application No. 62/235,326 filed on Sep. 30, 2015, and entitled "MAGNETIC SURFACE CONTACTS," the disclosure of which is incorporated by reference in its entirety and for all purposes.

FIELD

The described embodiments relate generally to a connector for an accessory device capable of exchanging power and data with an electronic device. In particular, the connector includes recessed contacts that are magnetically actuated by magnets associated with contacts of the electronic device.

BACKGROUND

In an effort to progressively improve the functionality of a portable electronic device, new ways of configuring an accessory device are desirable. A variety of accessory devices are available that can augment the functionality of host electronic devices such as tablet computers, smart phones, laptop computers, etc. These accessory devices often include electronic circuitry and one or more embedded batteries that power the electronic circuitry. In many such devices the batteries can be charged by connecting an appropriate cable to a charging port. Such ports and the contacts positioned therein can be susceptible to damage, etc. Consequently, an accessory device with more robust and/or protected charging contacts is desirable.

SUMMARY

This disclosure describes various embodiments that relate to a magnetic accessory connector having magnetically actuated electrical contacts.

A magnetically actuated connector is disclosed and includes a floating contact having an exterior portion formed of electrically conductive material and an interior portion including a magnet. The magnetically actuated connector also includes a flexible circuit that includes a flexible attachment feature. The flexible attachment feature is electrically coupled to the floating contact and configured to accommodate movement of the floating contact between a first position and a second position.

An accessory device is disclosed and includes the following: a device housing; and a magnetically actuated connector arranged along an exterior surface of the device housing. The magnetically actuated connector includes a floating contact having an exterior portion formed of electrically conductive material and an interior portion that includes a magnet. The magnetically actuated connector also includes a flexible circuit having a flexible attachment feature that is soldered to the floating contact and configured to accommodate movement of the floating contact between a first position and a second position.

Another accessory device is disclosed and includes the following: a device housing; and a magnetically actuated connector arranged along an exterior surface of the device housing. The magnetically actuated connector includes an electrical contact having an exterior portion formed of electrically conductive material and an interior portion that includes a magnet. The magnetically actuated connector also includes an electrically conductive pathway electrically coupling the electrical contact to circuitry of the accessory device. The electrically conductive pathway is configured to accommodate movement of the electrical contact between a first position and a second position.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

Figure 1:
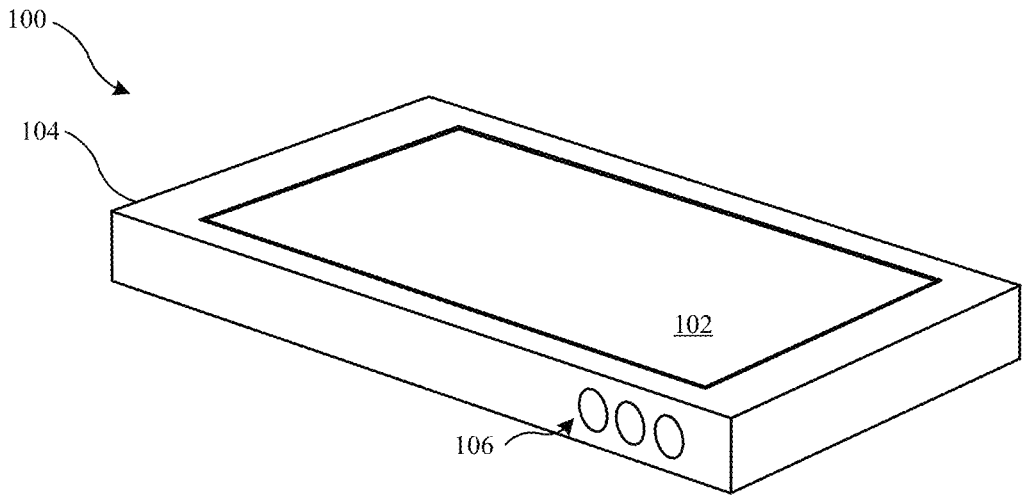
FIG. 1 shows various portable electronic devices suitable for use with embodiments disclosed herein.

Other aspects and advantages of the invention will become apparent from the following detailed description taken in conjunction with the accompanying drawings which illustrate, by way of example, the principles of the described embodiments.

DETAILED DESCRIPTION

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

The operation and utility of electronic devices can often benefit from interaction with various accessory devices. Input devices can be particularly effective at enhancing utility as they provide new ways and manners for interacting with the device. Unfortunately, these input devices are often electronic in nature and often require cumbersome and easily misplaced charging and/or data cables for applying any number of firmware updates, content loading and charging operations to the accessory device.

One solution to this problem is to include a built-in connector with an electronic accessory device that provides a conduit for exchanging power and/or data between the accessory device and another electronic device. In some embodiments, the built-in connector of this accessory device can include a floating contact design. The floating contacts can be positioned in a recessed position when the connector is not in use and in an engaged position when the connector is in use. By stowing the floating contacts in a recessed position when not in use, the electrical contacts of the floating contacts can be prevented from experiencing excessive wear on account of rough or careless handling leading to scratching or degrading of the electrical contacts. The floating contacts can include a magnetic element that drives the floating contacts between the recessed and engaged positions. In some embodiments, the magnetic elements can be attracted to a magnetically attractable element within the accessory device when the connector is not in use. When the connector engages a connector of another electronic device, the connector of the electronic device can include one or more magnetically attractable elements that attract the magnets within the floating contacts with an amount of force sufficient to overcome the magnetic coupling between the magnets and the magnetically attractable element within the accessory device. In this way, the floating contacts can move between the engaged and recessed positions without any expenditure of energy by the accessory device.

The accessory device can also include flexible electrically conductive pathways that remain attached to the floating contacts in both the recessed and engaged positions. In some embodiments, the flexible electrically conductive pathways can take the form of one or more flexible circuits. In one particular embodiment, the flexible circuit can take the form of a number of electrically conductive pathways printed upon a polymeric substrate. The polymeric substrate can include a cutout pattern that allows portions of the substrate to accommodate movement of the floating contacts without placing an undue amount of strain on the polymeric substrate. In this way, the electrical coupling between the floating contacts and the flexible circuits can be maintained in both positions.

This application also discloses additional embodiments related to moving connector elements. In particular, various pogo pin embodiments are disclosed. Pogo pins typically include a spring-loaded depressible electrical contact. Some of the disclosed pogo pin embodiments include an internal movable magnet that cooperates with a spring to oppose depression of the electrical contact. Additional embodiments are disclosed that include movable magnets that are configured to assist in connection and/or alignment of electrical connectors.

These and other embodiments are discussed below with reference to FIGS. 1-11; however, those skilled in the art will readily appreciate that the detailed description given herein with respect to these figures is for explanatory purposes only and should not be construed as limiting.

Floating Contact Embodiments:

FIG. 1 shows a perspective view of a portable electronic device 100 suitable for use with embodiments disclosed herein. Portable electronic device 100 can represent a multiplicity of different electronic devices that include a laptop, cell phone, wearable device, tablet device, media device and the like. Portable electronic device 100 can include a display assembly 102 positioned within a front opening defined by device housing 104. Device housing 104 is also configured to protect various electrical components disposed within device housing 104. Device housing 104 can also define openings within which contacts making up connector 106 can be positioned. The electrical contacts of connector 106 can be configured to provide a means through which portable electronic device 100 can communicate with and exchange power with various accessory devices. A wide variety of accessory devices can benefit from such a connector including but not limited to a powered cover or case, an external battery pack enclosure, an external keyboard, a stylus, a wireless headset or earbuds, a docking station and the like.

Figure 2A:
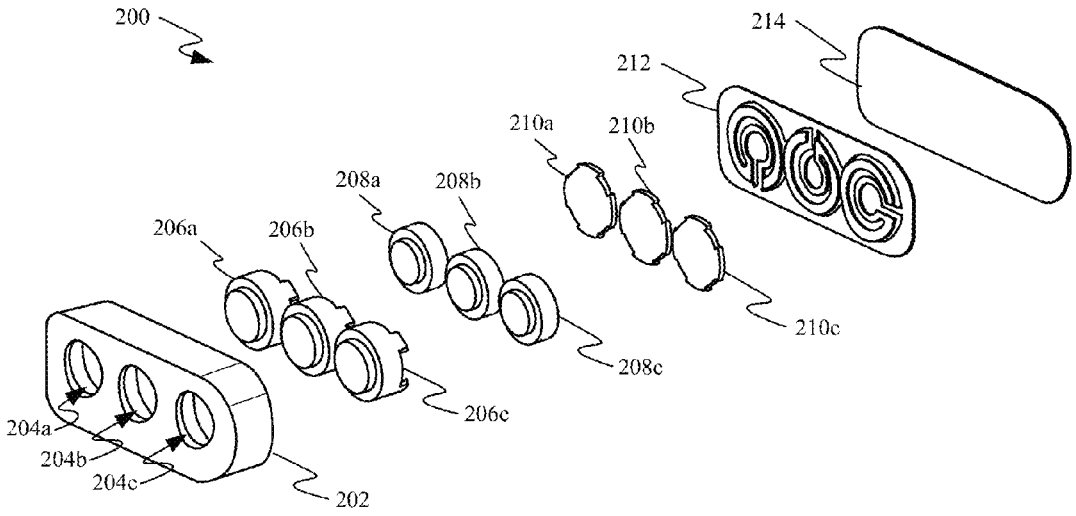
FIGS. 2A-2B show exploded views of a connector configured to be built into an accessory device.
Figure 2B:
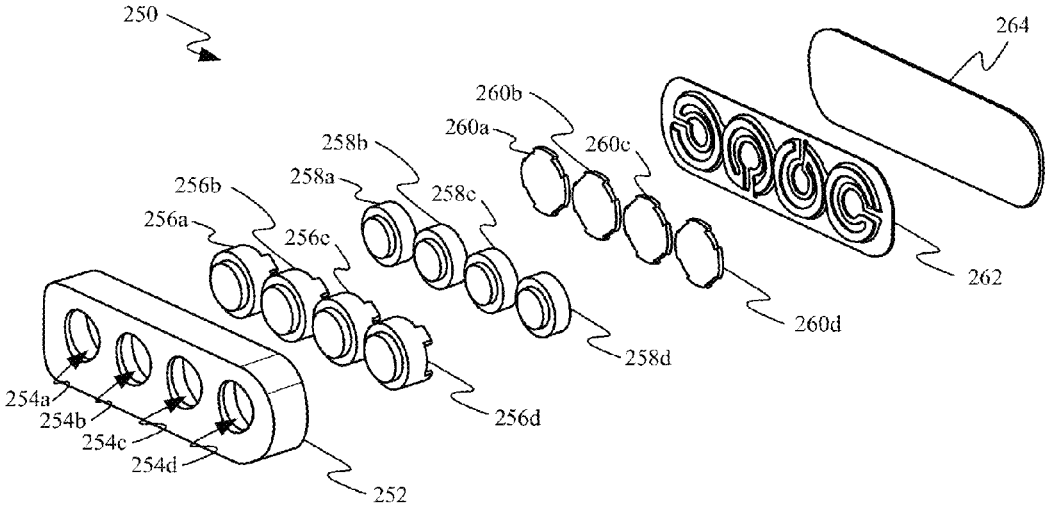

FIGS. 2A-2B show an exploded view of a connector configured to be built into an accessory device. FIG. 2A shows protective cover 202. Protective cover 202 can be formed form an insulating material along the lines of glass fiber reinforced nylon or any rigid polymer. Protective cover 202 could also be formed of insulating materials along the lines of ceramic materials. Protective cover 202 can have an exterior surface with a curvature suited to match a device surface to which it is designed to be coupled with. As depicted, protective cover 202 defines multiple openings 204*a*-204*c* within which electrical contacts of the connector can be positioned. An interior portion of protective cover 202 can define a channel corresponding to each opening that accommodates at least a portion of an electrical contact of connector 200. The channels defined by protective cover 202 can also help to guide the contacts between recessed and engaged positions. One or more of electrical contacts 206*a*-206*c* can take the form of electrically conductive shells, as depicted. In some embodiments, electrical contacts 206*a*-206*c* can have a minimal thickness configured primarily as an electrically conductive shell for guiding power and data from the electronic device to which it couples and electrically conductive pathways within the accessory device. In some embodiments, electrical contacts 206*a*-206*c* can have an average thickness of about 0.15 mm and be formed from a phosphorous bronze alloy. One reason the thickness of electrical contacts 206*a*-206*c* can be so thin is that the contacts are recessed when not in use which prevents un necessary wear and tear on electrical contacts 206*a*-206*c*. Magnets 208*a*-208*c* can take the form of high-strength permanent magnets, such as rare-earth magnets along the lines of neodymium magnets. Magnets 208*a*-208*c* can have a size and shape complementary to an interior geometry of electrical contacts 206*a*-206*c*, so that magnets 208 can be coupled with an interior volume defined by electrical contacts 206. In some embodiments, magnets 208 can be adhesively coupled to an interior surface of a corresponding contact 206.

Connector 200 can also include a number of magnetic shunts 210. Magnetic shunts 210 can be affixed to a rear-facing portion of a corresponding contact 206, thereby forming a number of floating contacts that each include contact 206, magnet 208 and magnetic shunt 210. Magnetic shunt 210 stays directly behind magnets 208 so that a magnetic fields emitted by magnets 208 are concentrated towards openings 204 defined by protective cover 202. Magnetic shunts are generally made from a material resistance to the passage of magnetic fields. One common material utilized for magnetic shunts is stainless steel on account of it being able to redirect magnetic fields that would otherwise pass through the magnetic shunt. The magnetic fields emitted by magnets 208 can be arranged in various polarity patterns that help to encourage proper lineup between the floating contacts and corresponding contacts on a portable electronic device. For example, centrally positioned magnets could have one polarity and magnets arranged on the periphery could have an opposite direction polarity. These polarities could be matched with polarities associated with contacts of the portable electronic device. It should be noted that in some embodiments, electrical contacts 206 can include a seal that interacts with protective cover 202 to prevent the intrusion of moisture into an associated accessory device through 200. For example, each of electrical contacts 206 can include an o-ring that creates an interference fit with a portion of protective cover 202 at least when the floating contacts are in the recessed position.

The floating contacts can be soldered to solder pads on flexible printed circuit board (PCB) 212. The solder pads are situated on portions of a flexible circuit taking the form of flexible PCB 212 that have been partially separated from the rest of flexible PCB 212. In this way, the portions of the flexible PCB upon which electrical contacts 206 are attached allow substantial movement of electrical contacts 206 away from flexible PCB 212, so only minor amounts of stress are applied to flexible PCB 212 during movement of the floating contacts. By having three floating contacts, each of the floating contacts can be arranged to provide power, a ground or a data signal. When the central contact is associated with power, connector 200 can be arranged to accept either a ground or a data signal at either of the peripheral contacts. In this way, connector 200 can be coupled to a portable electronic device in either of two different orientations. Flexible printed circuit board 212 can be adhesively coupled with DC shield 214. FIG. 2B shows a connector 250 having a configuration similar to that shown in FIG. 2A with the inclusion of a fourth contact depicted as contact 256*d*. In some embodiments, the fourth contact 256*d* can provide additional power for connector 250. In other embodiments, the additional contact 256*d* can provide an additional data port for increasing a transmission speed of data through connector 250.

Figure 3A:
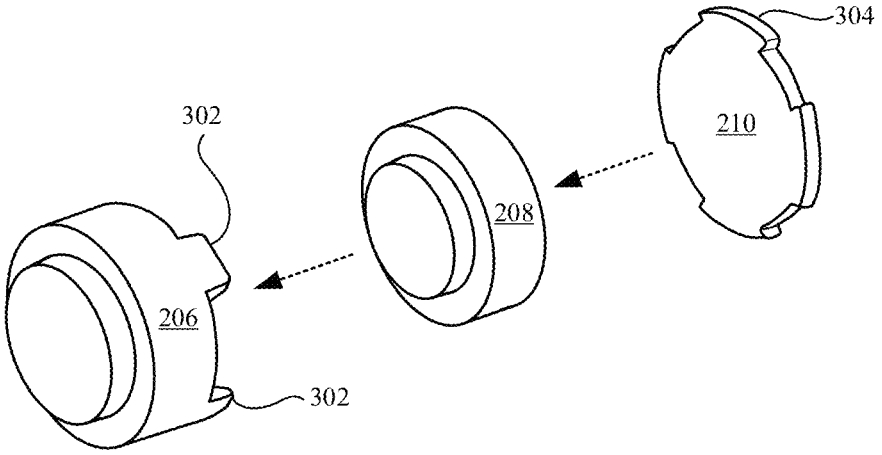
FIG. 3A shows how floating contacts are assembled together from an electrical contact, a magnet and a magnetic shunt.
Figure 3B:
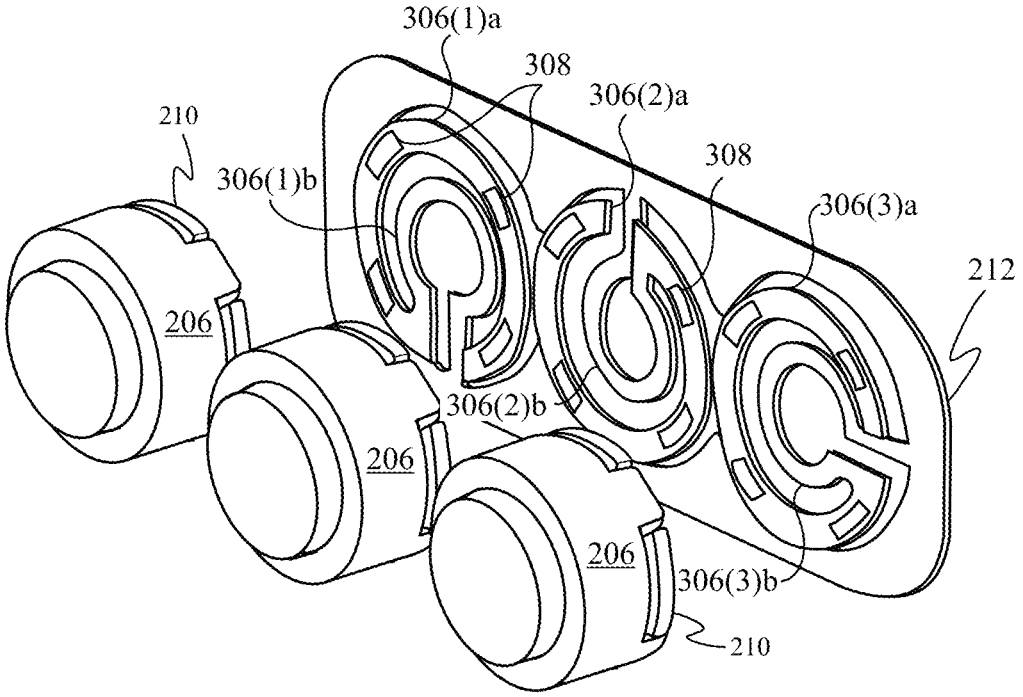
FIG. 3B shows the floating contacts assembled and attachment features of a flexible printed circuit board.

FIG. 3A shows how the floating contacts are assembled together from electrical contact 206, magnet 208 and magnetic shunt 210. The arrows depicts how magnet 208 is inserted into a rear opening defined by electrical contact 206 and then how magnetic shunt 210 fits between multiple tails 302 of electrical contact 206. FIG. 3B shows the floating contacts assembled and how protrusions 304 of magnetic shunt 210 fit between each of a number of tails 302 of electrical contact 206. In some embodiments, electrical contact 206 can be adhesively coupled to both magnet 208 and magnetic shunt 210.

FIG. 3B also shows a detailed view of flexible PCB 212. Flexible PCB includes multiple electrically conductive pathways that couple the floating contacts with circuitry within the accessory device. Here it can be seen how flexible PCB 212 includes attachment features 306 that take the form of inner and outer rings of material of flexible PCB 212, which gives each of attachment features 306 a somewhat spiral shaped geometry. In particular, one of attachment features 306 includes outer ring 306(1)*a* and inner ring 306(1)*b*. Outer ring 306(1)*a* includes multiple solder pads 308 by which each attachment features 306 can be electrically and mechanically coupled with a floating contact and in particular with tails 302 of the floating contact. Outer ring 306(1)*a* is coupled to the rest of flexible PCB 212 by inner ring 306(1)*b*, which is in turn attached to the rest of flexible PCB 212 by an attachment member that takes the form of a narrow strip of material. On account of attachment features 306 following a linear path that includes multiple turns, attachment features 306 can allow the floating contacts to transition between engaged and recessed positions while placing minimal stress on attachment features 306 and flexible PCB 212. This motion is accommodated primarily by the inner ring of each of attachment features 306 since the outer ring is soldered in four places to tails 302 of electrical contacts 206. When connector 200 transitions between recessed and engaged positions attachment features 306 undergo a telescoping action to accommodate the motion. It should also be noted that while each of attachment features 306 is depicted as being oriented in a different direction, that the flexible connectors could also each be oriented in the same direction or have their orientations vary in different amounts or patterns.

Figure 3C:
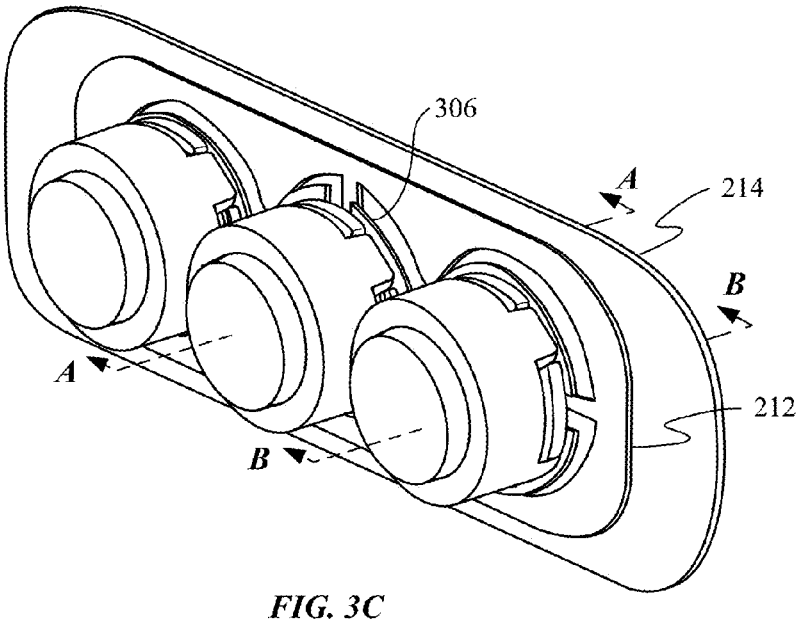
FIG. 3C shows a view of the floating contacts soldered to the solder pads arranged on attachment features of the flexible printed circuit board.

FIG. 3C shows a view of the floating contacts soldered to the solder pads arranged on attachment features 306 of flexible PCB 212. FIG. 3C also shows how flexible PCB 212 can be adhesively coupled with DC shield 214. DC shield can be formed from any number of magnetically attractable materials. In one particular embodiment DC shield 214 can be formed for stainless steel (SUS) 430. In another embodiment, DC shield 214 and magnetic shunts 210 can be formed of a cobalt iron alloy. It should be noted that in some embodiments only a periphery of flexible PCB 212 is coupled with DC shield 214, thereby allowing attachment features 306 to telescope away from DC shield 214 to accommodate movement of the floating contacts. Flexible PCB 212 can be coupled to DC shield 214 in many ways including by a layer of adhesive. In some embodiments, the layer of adhesive forms an insulating layer that electrically isolates flexible PCB 212 from DC shield 214.

Figure 3D:
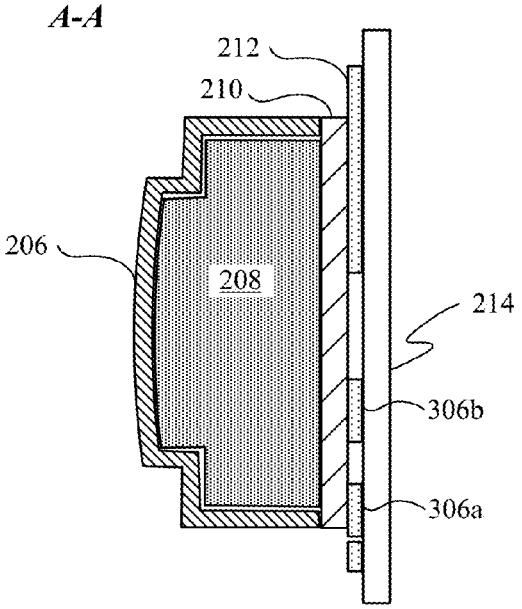
FIG. 3D shows a cross-sectional view of a floating contact coupled with a DC shield by way of a flexible PCB in accordance with section line A-A.

FIG. 3D shows a cross-sectional view of a floating contact coupled with DC shield 214 by way of flexible PCB 212 in accordance with section line A-A. Section line A-A runs across a central portion of the floating contact and consequently magnetic shunt 210 runs across a diameter of electrical contact 206. In this way magnetic shunt 210 can be well positioned to prevent a magnetic field emitted by magnet 208 from extending towards DC shield 214 and into the accessory device.

Figure 3E:
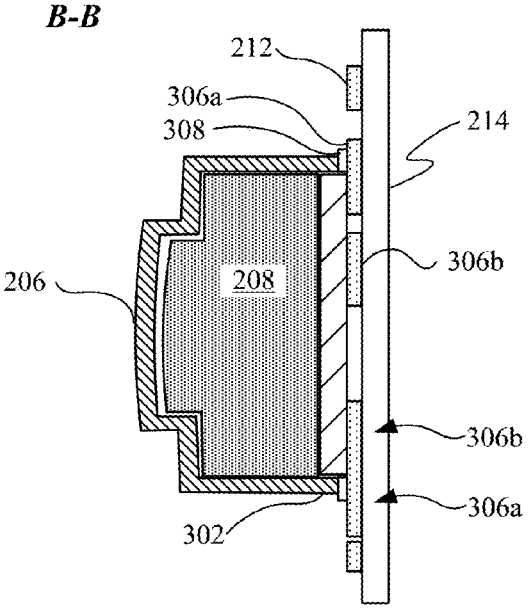
FIG. 3E shows a cross-sectional view of another floating contact coupled with a DC shield by way of a flexible PCB in accordance with section line B-B.

FIG. 3E shows a cross-sectional view of another floating contact coupled with DC shield 214 by way of flexible PCB 212 in accordance with section line B-B. In FIG. 3E tails 302 of electrical contacts 206 are depicted extending all the way to solder pads 308. In this way electrical traces on flexible PCB 212 can be electrically coupled to electrical contact 206 by way of solder pads 308 and tails 302. This allows ground, power or data to pass through electrical contact 206 and over to another electrical device, while bypassing magnet 208 and magnetic shunt 210. Although a particular configuration of four pads and essentially two rings of the spiral attachment features are depicted the spirals and solder pads can be arranged in many other ways and in many other configurations. For example, in some embodiments when a longer floating contact travel is desired flexible PCB 212 can include three or four spirals or rings allowing flexible attachment features 306 to accommodate a much longer range of travel. Similarly, in some embodiments, electrical contacts 206 may only include three feet soldered to three solder pads of outer ring 306*a* of attachment feature 306.

Figure 4A:
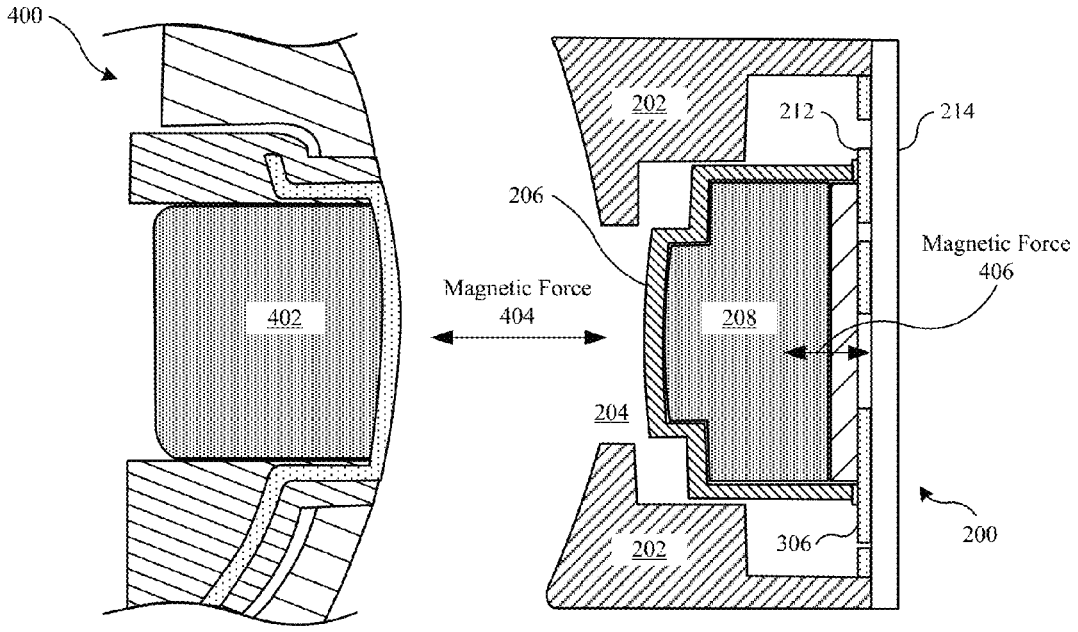
FIGS. 4A-4B show recessed and engaged positions of a connector.
Figure 4B:
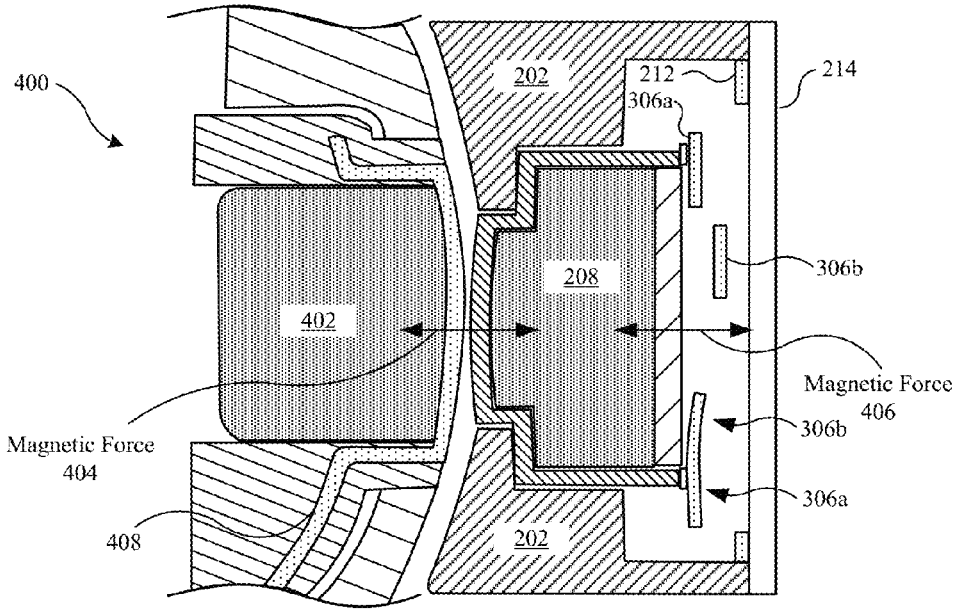

FIGS. 4A-4B show recessed and engaged positions of connector 200. FIG. 4A shows how a magnetic force 404 acts between magnet 208 of connector 200 and magnet 402 of the electronic device 400. In FIG. 4A magnet 402 is too far away to overcome the magnetic force 406 that operates between DC shield 214 and magnet 208. FIG. 4B shows how once electrical device 400 and particularly magnet 402 get close enough to magnet 208 magnetic force 404 becomes large enough to overcome magnetic force 406. FIG. 4B also shows the spiral configuration assumed by attachment feature 306 of flexible PCB 212, which accommodates the floating contacts movement into the engaged position. As depicted, portions of flexible attachment feature 306 (i.e. inner ring 306*b*) deform to accommodate the motion of the floating contact towards electronic device 400. Once electronic device 400 engages connector 200, electrical contact 408 of electronic device 400 becomes electrically coupled with electrical contact 206. It should be noted that while electrical contact is shown as having a convex geometry the geometry can alternatively be concave to match a geometry of electrical contact 408. It should also be noted that electronic device 400 can have multiple electrical contacts 408. One electrical contact 408 corresponds to each of electrical contacts 206 of connector 200. In some embodiments, where electrical contact 206 sticks out past a mating surface defined by protective cover 202 the magnetic coupling may push electrical contact 206 back slightly into connector 200 so that an exterior surface of electronic device 400 can also contact the curved surface defined by protective cover 202.

Figure 5A:
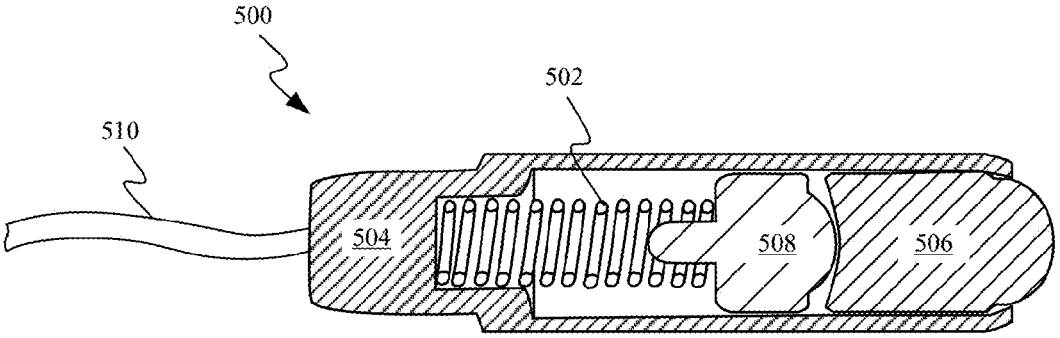
FIGS. 5A-5B show a variety of pogo pins configured to electrically couple with another electrical contact.
Figure 5B:
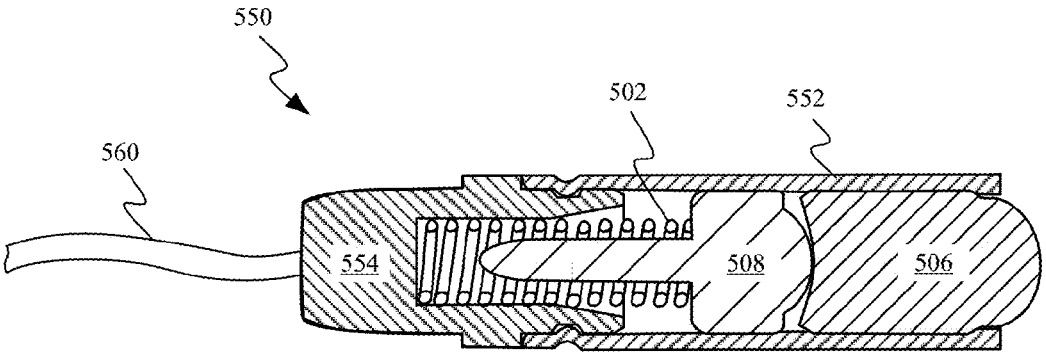

Pogo Pin Embodiments:

FIGS. 5A-5B show pogo pins configured to electrically couple with another electrical contact. FIG. 5A shows a pogo pin 500 with a spring 502 embedded within housing 504. Spring 502 is configured to allow electrical contact 506 to retract into housing 504 of pogo pin 500. Pogo pin 500 can also include spring coupling device 508, which includes a protrusion for mating with spring 502. The convex surface of spring coupling device 508, which contacts electrical contact 506, is designed to encourage misalignment of spring coupling device 508 and electrical contact 506. This misalignment results in electrical contact 506 being pressed against an interior-facing surface of housing 504. The electrical contact between electrical contact 506 and housing 504 allows electricity and/or data to be transferred from electrical contact 506 to housing 504 and then out of pogo pin 500 entirely by way of electrically conductive pathway 510. Electrically conductive pathway 510 can take the form of one or more wires that carry the power and/or signals to another electrical component for further processing. In some embodiments, multiple pogo pins 500 can be used in a single connector to carry different power levels and signal types. It should be noted that the misalignment created by spring coupling device 508 that establishes a solid connection between electrical contacts 506 and housing 504 prevents the unfortunate situation in which electrical contact 506 remains axially aligned with spring 502 and not in significant contact with housing 504. In the aforementioned axial alignment situation, electricity could be forced to travel through spring 502, and since spring 502 is not designed to carry electricity the risk of a short circuit and/or damage to the spring increases substantially. The spring shape of spring 502 can also add unwanted inductance to any signal transmitted through spring 502. It should also be noted that assembly of pogo pin 500 involves inserting the internal components of pogo pin 500 through a front opening defined by housing 504.

FIG. 5B shows a pogo pin 550 and how a housing 552 of pogo pin 550 can be formed from front housing component 552 and rear housing component 554. This configuration allows insertion of internal components of pogo pin 550 through a rear facing opening of front housing component 552. In such a configuration a front opening defined by front housing component 552 can be a rigid opening that need not be configured to accept internal components. Instead the internal components can be inserted through the rear facing opening defined by front housing component 552. A portion of front housing component 552 can be swaged to produce an annular protrusion configured to engage an annular recess defined by rear housing component 554. The complementary recess and protrusion allows a straight forward fastener-free coupling between front housing component 552 and rear housing component 554. Because the internal components don't need to be inserted through the front opening of front housing component 552, the front opening through which electrical contact 506 extends can be substantially more rigid, thereby reducing the likelihood of electrical contact 506 inadvertently passing through the front opening.

Figure 6A:
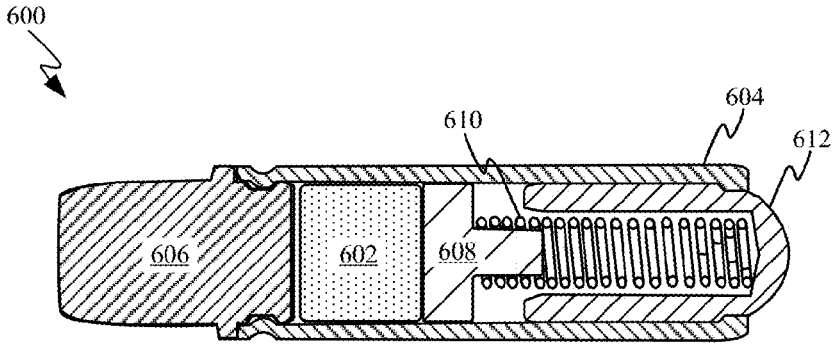
FIG. 6A shows a cross-sectional side view of a pogo pin having an integrated movable magnet.
Figure 6B:
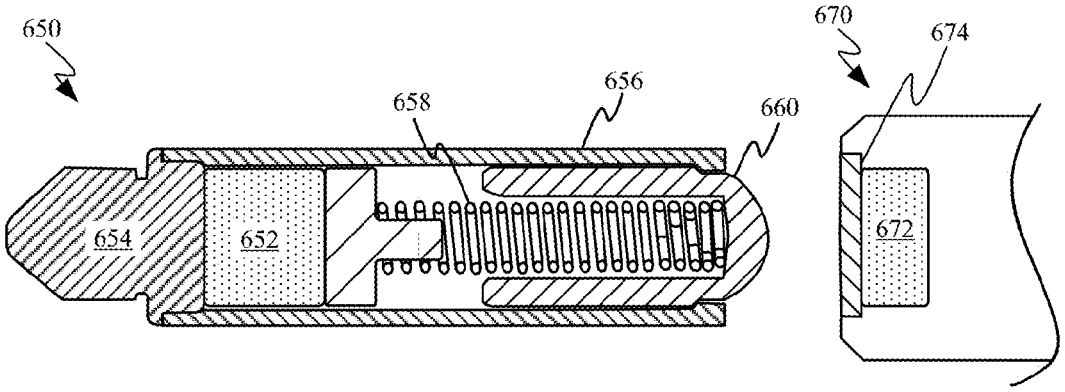
FIG. 6B depicts a pogo pin that differs slightly from the pogo pin depicted in FIG. 6A in that the rear housing component utilizes a press-fit feature to couple with the front housing component.
Figure 6C:
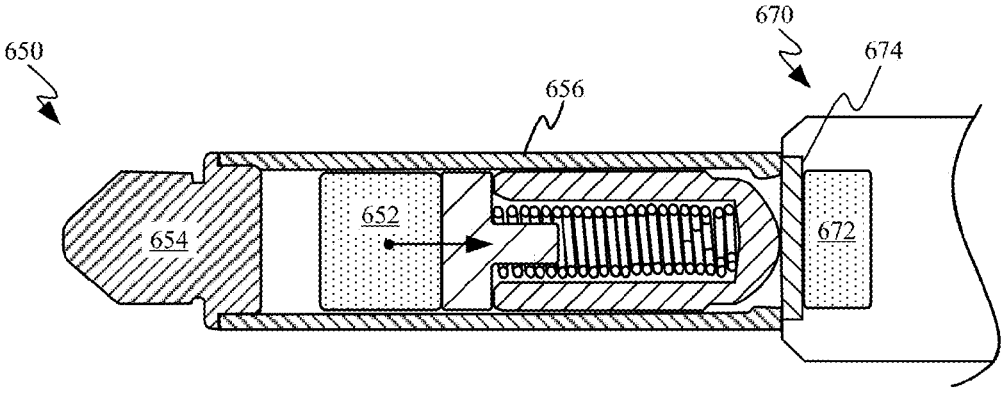
FIG. 6C depicts how an electrical contact can be depressed slightly into the front opening of a housing component on account of a force being exerted on the electrical contact.

FIGS. 6A-6C show cross-sectional side views of pogo pins with integrated movable magnets. FIG. 6A shows a cross-sectional side view of a pogo pin 600 having an integrated movable magnet 602. Movable magnet 602 is positioned within an interior volume defined by front housing component 604 and rear housing component 606. The interior volume can take the form of a channel along which movable magnet 602 can pass. Movable magnet 602 is coupled to spring coupling device 608, which includes a protrusion that engages one end of spring 610. When an external magnetic field exerts a force upon movable magnet 602 directed towards electrical contact 612, movable magnet 602 slides along the channel to compress spring 610 against a rear-facing surface of electrical contact 612. In this way, movable magnet 602 can be used to augment the force provided by spring 610 when pogo pin 600 is exposed to the external magnetic field.

FIG. 6B depicts a pogo pin 650 that differs slightly from pogo pin 600 in that rear housing component 614 utilizes a press-fit feature to couple with front housing component 656. In some embodiments, the press-fit feature includes ridges that embed themselves in the interior surface of front housing component 656, so that a permanent coupling between front housing component 656 and rear housing component 654 is achieved. FIG. 6B also depicts connector 670, with which pogo pin 650 is configured to electrically couple. As depicted in FIG. 6B, pogo pin 650 is separated from electronic device by a distance sufficient to prevent substantial interaction between movable magnet 652 and external magnet 672. The polarity of movable magnet 652 can be arranged so that interaction with an external magnet 672 of connector 670 results in a magnetic force that causes movable magnet 652 to compress spring 658 once the distance between magnet 652 and 672 gets small enough, as depicted in FIG. 6C. Once pogo pin 650 is drawn far enough away from external magnet 672, spring 658 biases movable magnet 652 back to the position shown in FIG. 6B.

FIG. 6C also depicts how electrical contact 660 can be depressed slightly into the front opening defined by front housing component 656 on account of physical contact between contact area 674 and electrical contact 660. The inclusion of movable magnet 652 essentially increases the contact force between electrical contact 660 and contact area 674, thereby increasing the efficiency of the electrical connection. In some embodiments, a size and/or strength of springs 610 and 658 can be reduced on account of the additional force provided by movable magnets 602 and 652. While no electrically conductive pathways are depicted in FIGS. 6A-6C it should be understood that any of the depicted pogo pins 600-650 can be integrated with other electrical components by electrically conductive pathways similar to the ones depicted in FIGS. 5A-5B.

Figure 7A:
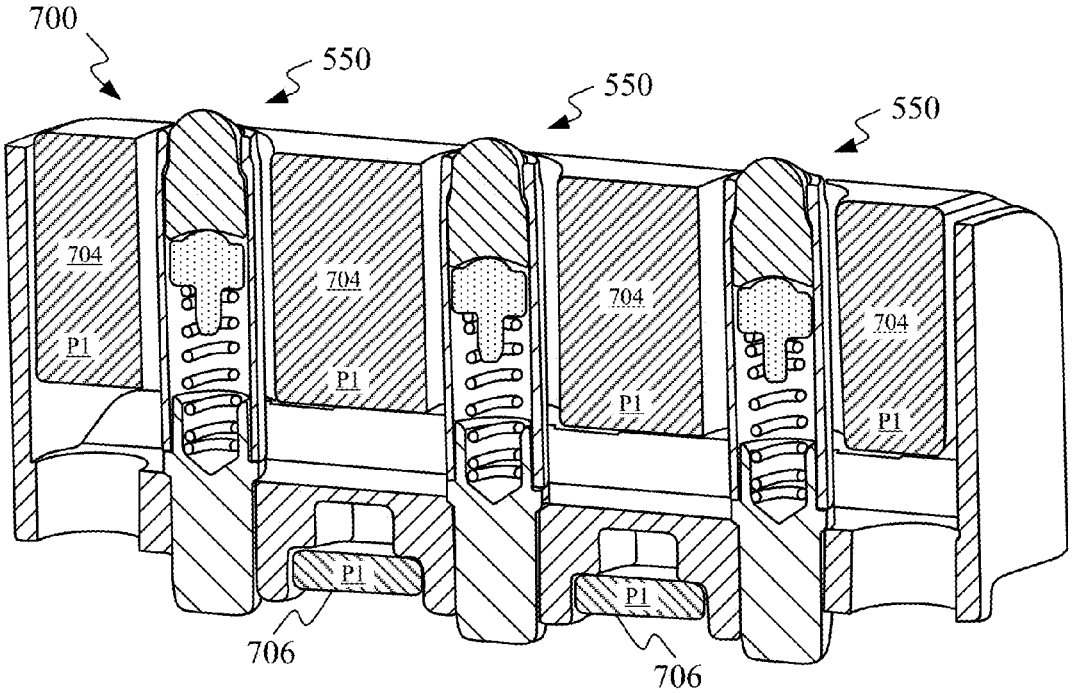
FIGS. 7A-7B show first and second positions of an electrical connector 700 utilizing pogo pins similar to those described in FIGS. 5A-5B.
Figure 7B:
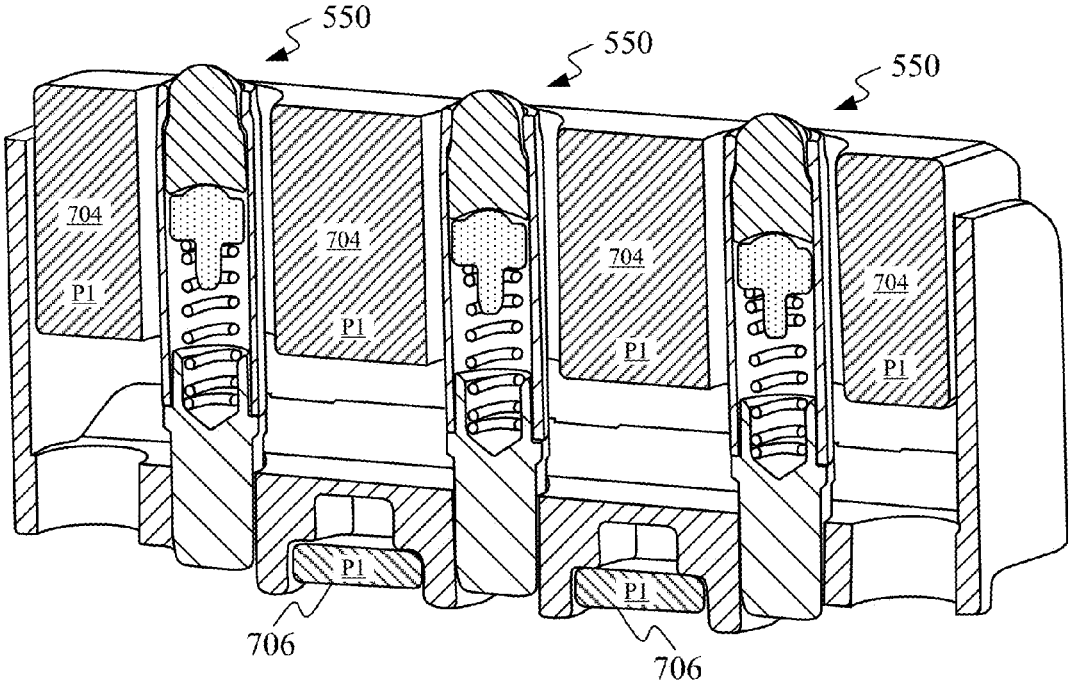

FIGS. 7A-7B show first and second positions of an electrical connector 700 utilizing pogo pins similar to those described in FIGS. 5A and 5B. In particular, FIG. 7A shows multiple pogo pins 550 protruding from a mating component 704. While three pogo pins 550 are depicted it should be understood that a larger or smaller amount of pins can be used depending on multiple design factors. Mating component 704 can be formed from a magnetically attractable or in some cases magnetic material. While all of mating component 704 is depicted as having a P1 polarity, it should be understood that mating component 704 can also be magnetized to have multiple poles with different polarities. An exterior facing surface of mating component 704 can be designed to contact and adhere to a connector to which electrical connector 700 is configured to be electrically coupled. Electrical connector 700 can include a series of magnets 706 positioned beneath mating component 704. Magnets 706 can be configured to attract mating component 704 so it remains in a stowed position (depicted in FIG. 6A) regardless of an orientation of electrical connector 700.

FIG. 7B shows how mating component 704 can move from the stowed position depicted in FIG. 7A to a mating position. The movement from the stowed position to the mating position depicted in FIG. 7B can be achieved by the application of an external magnetic field to mating component 704. When the external magnetic field applied to mating component 704 becomes large enough to exceed the strength of the magnetic field emitted by magnets 706, mating component 704 transitions from the stowed position to the mating position. The mating position can be configured to reduce the escape of stray flux when electrical connector 700 is in use. For example, the protruding portion of mating component 704 can be received into a receptacle connector having a recess that substantially blocks the escape of any magnetic field lines being emitted from mating component 704. The magnetic attraction between mating component 704 and magnetically attractable or magnetic materials within another connector with which electrical connector 700 is engaged can also improve the mechanical coupling between electrical connector 700 and the other connector (not depicted).

Figure 7C:
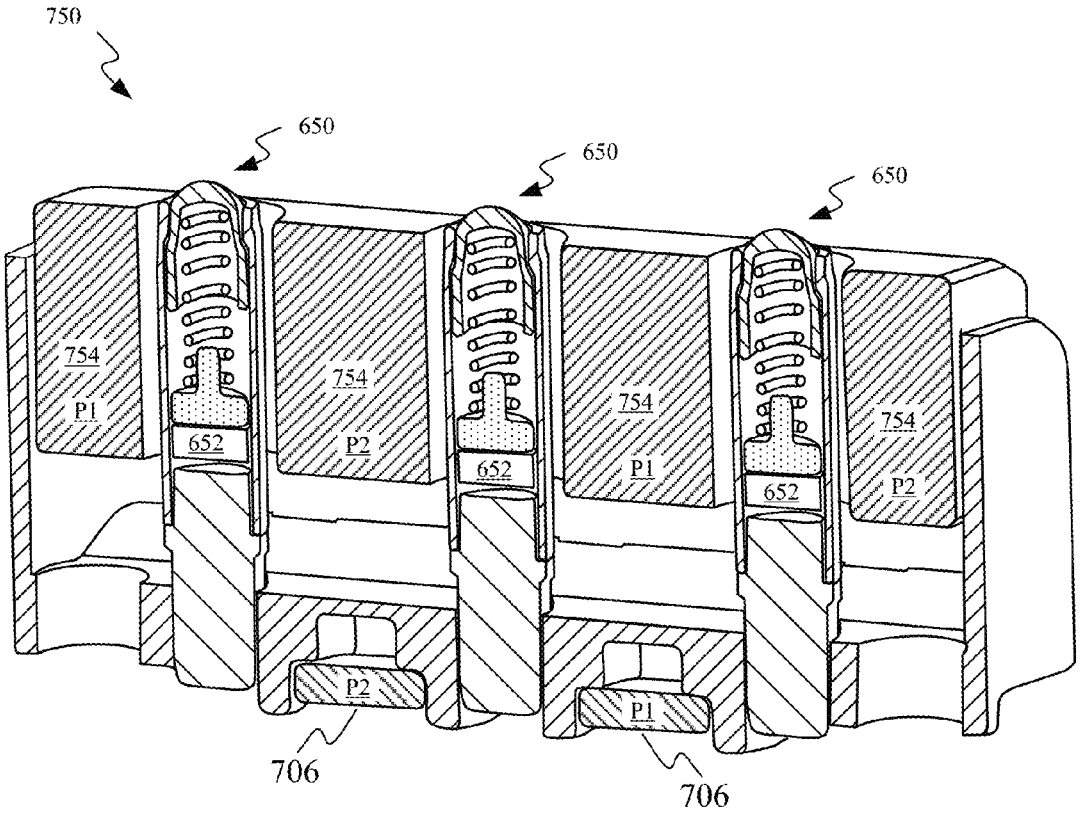
FIG. 7C shows an electrical connector utilizing magnetic pogo pins similar to the pins depicted in FIGS. 6A-6C.

FIG. 7C shows an alternate embodiment in which magnetic pogo pins 650 similar to the pins depicted in FIGS. 6A-6C are utilized. It should be noted that the movable magnets within the pogo pins can still be attracted and contribute to compression of corresponding pogo pins. In embodiments where mating component 754 is a multi-pole magnet (as depicted) the movable magnet configuration can work on account of the parallel field lines caused by the multiple adjacent poles cancelling one another out in the region of the pogo pin. Consequently, the movable magnets can still be utilized to augment the strength of the springs. In some embodiments, the polarity of magnets 652 can alternate or vary in another pattern to correspond to a pattern established by the receptacle connector. It should be noted that in addition to mating component 754 being configured to extend out to the mating position, connector 750 can be configured to shift laterally to align with the receptacle connector. In some embodiments, connector 750 could be positioned in a channel allowing the electrical connector to move laterally to accommodate any lateral alignment problems.

Figure 8A:
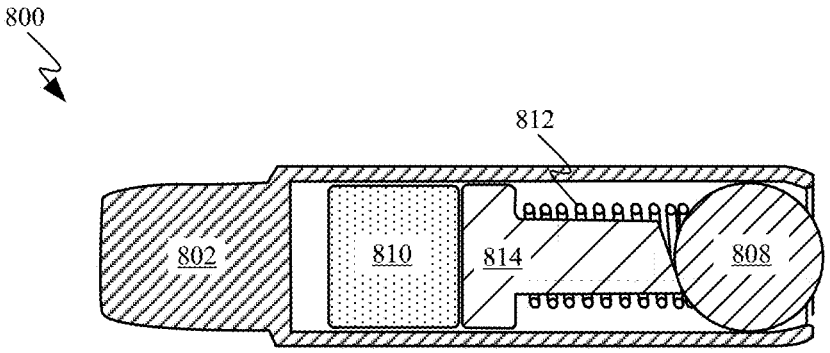
FIGS. 8A-8B show cross-sectional views of magnetic ball style pogo pins.
Figure 8B:
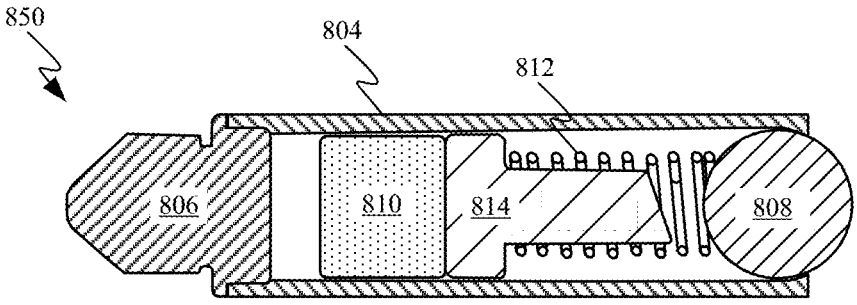

FIGS. 8A-8B show cross-sectional views of magnetic ball style pogo pins 800 and 850. FIG. 8A depicts a unibody housing 802 while FIG. 8B depicts a two-part housing including front housing component 804 and rear housing component 806. Both have electrical contacts with ball designs that allows for free rotation of electrical contacts 808 in many different directions. In some embodiments, electrical contacts 808 can take the form of a non-conductive spherical substrate plated in electrically conductive material along the lines of gold or copper. In this way, electricity travelling along the surface of electrical contacts 808 can conduct the electricity efficiently to housing 802 and housing component 604. The depicted design also includes movable magnet 810 configured to increase a preload generated by internal spring 812, by virtue of attraction between movable magnet 810 and magnetic ball contact 808. Pogo pins 800 and 850 also include spring coupling devices 814 with protrusions engaged within internal spring 812. The protrusion includes a slanting surface that allows a lateral force to be imparted that biases electrical contact 808 towards an internal surface of housing 802 as depicted in FIG. 8A. The lateral force can be applied to improve the contact force between electrical contact 808 and housing 802, thereby improving the flow of electricity through pogo pin 800.

Figure 9A:
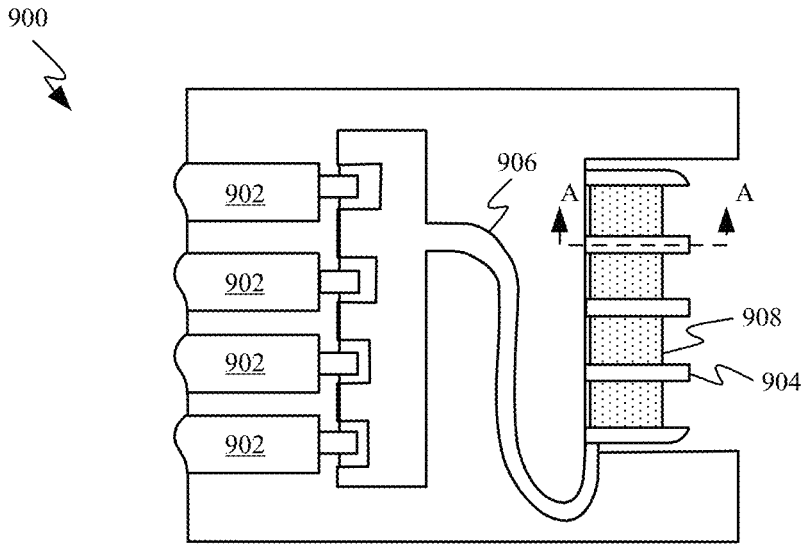
FIGS. 9A-9B show top views of a magnetic electrical connector.
Figure 9B:
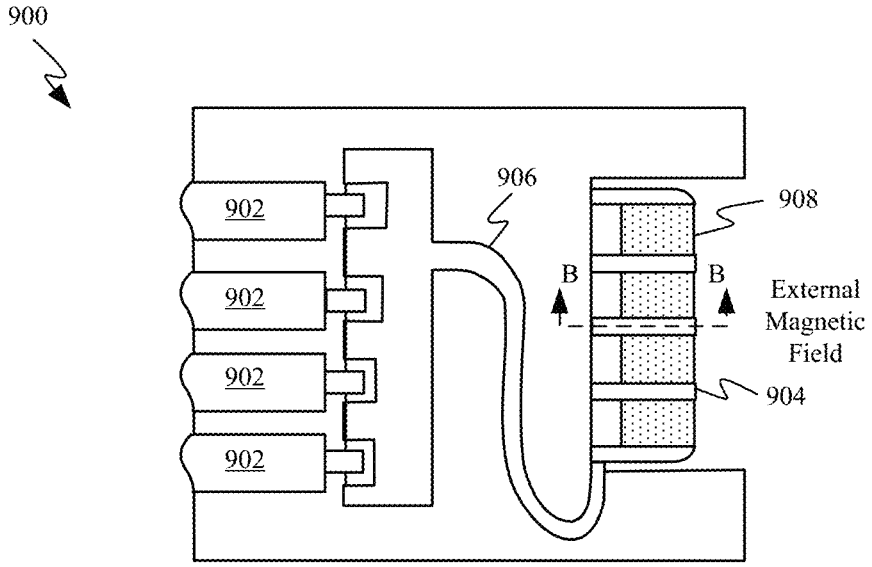

Electrical Connector Embodiments:

FIGS. 9A-9B show top views of a magnetic electrical connector 900. Magnetic electrical connector includes power and/or data circuits 902 that are routed to electrical contacts 904 by electrically conductive pathway 906. Electrically conductive pathway 906 can be made up of one or more wires that carry discrete signals to and from each of electrical contacts 904. In some embodiments, connector 900 can be include separate electrically conductive pathways 906 that run to each of electrical contacts 904. Electrical contacts 904 at least partially surround a movable magnet 908. Movable magnet 908 can be held in a retracted position (as depicted) by springs or other retaining features (not depicted). When an external magnetic field approaches electrical connector 900 as shown in FIG. 9B, magnet 908 is drawn towards the end of electrical contacts 904. This configuration can increase the strength of a magnetic coupling that helps maintain an electrical coupling between electrical connector 900 and another magnetic connector.

Figure 9C:
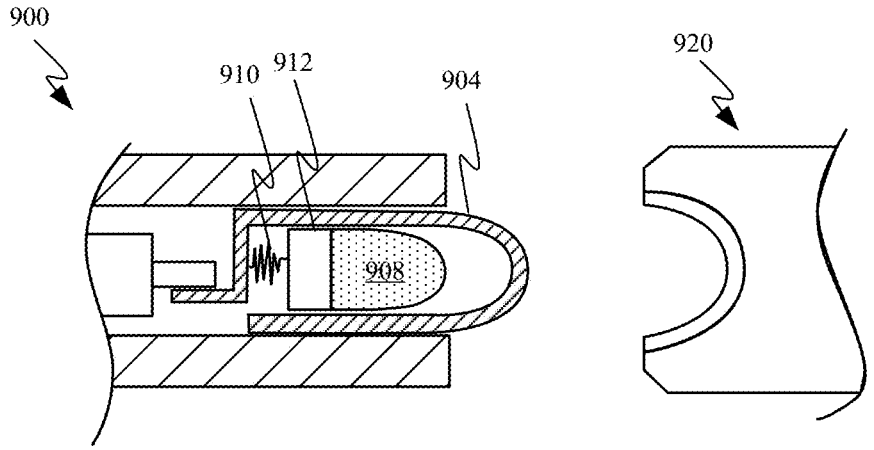
FIGS. 9C-9D show cross-sectional side views of the electrical connector depicted in FIGS. 9A-9B.
Figure 9D:
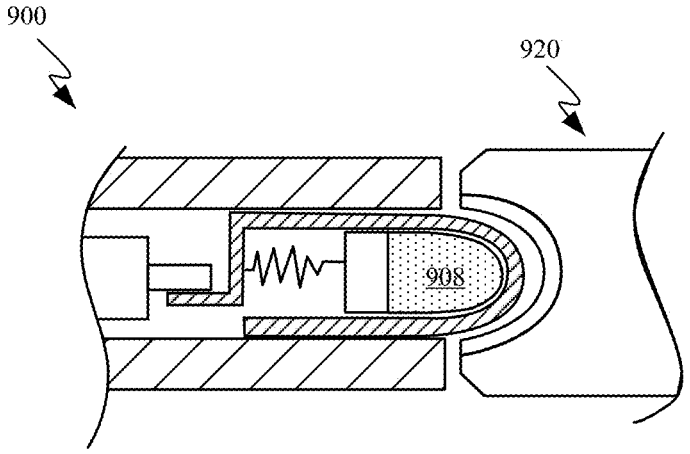

FIGS. 9C-9D show cross-sectional side views of electrical connector 900 in accordance with section lines A-A and B-B, respectively. In particular, FIG. 9C depicts a retention feature taking the form of spring 906. In FIG. 9C spring 910 is depicted having biased magnet 908 and shunt 912 towards a rear end of electrical contact 904. Shunt 912 directs a magnetic field emitted by magnet 908 out and away from connector 900 and towards connector 920. This can increase the range of magnet 908 and reduce the likelihood of that magnetic field from interfering with other electronics associated with connector 900.

FIG. 9D shows how when connector 900 gets close enough to connector 920 the resulting magnetic force between magnet 908 and connector 920 can exceed the force being applied by spring 910 so that magnet 908 is drawn towards the front of electrical contact 904. In this way, a magnetic coupling between electrical connector 900 and connector 920 can be maximized when the two connectors are coupled together.

Figure 10A:
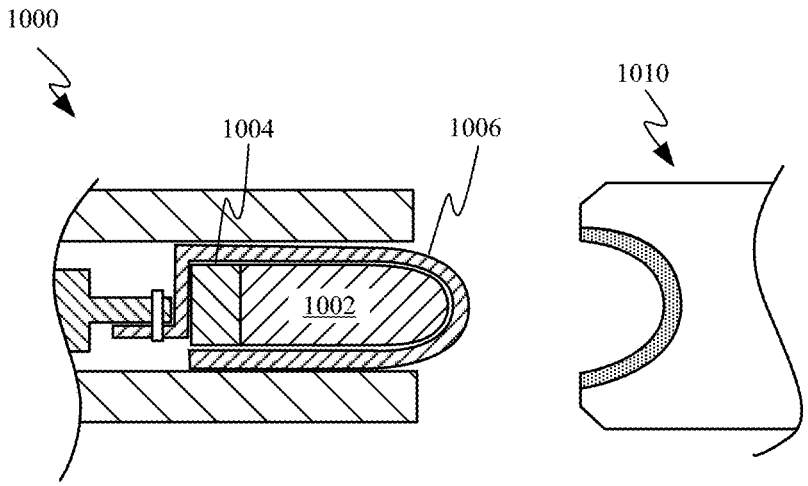
FIGS. 10A-10B show an alternative electrical connector design.
Figure 10B:
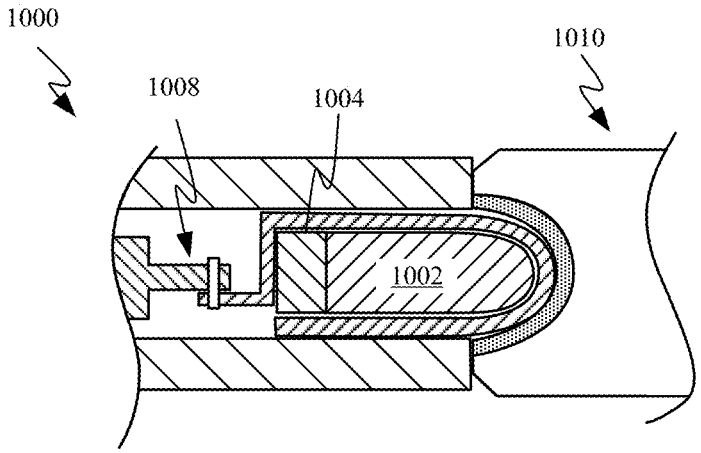

FIGS. 10A-10B show an alternative design taking the form of connector 1000. FIG. 10A depicts connector 1000 and how it includes magnet 1002 and shunt 1004, which both remain stationary with respect to electrical contact 1006 regardless of the application of an external magnetic field. FIG. 10B shows how both electrical contact 1006, magnet 1002 and shunt 1004 move in response to approaching magnetic connector 1010. This movement is made possible by a sliding connection between electrical contact 1006 and lead 1008. The sliding connection can take many forms, including but not limited to a bearing with stops allowing a predefined amount of movement of electrical contact 1004 with respect to lead 1008.

Figure 11A:
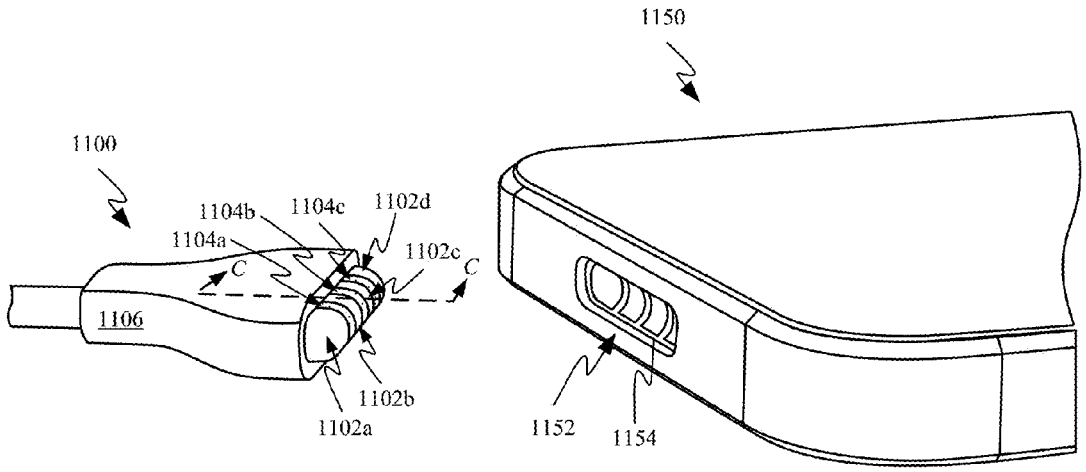
FIGS. 11A-11B show multiple views of another magnetic connector having a pill-shaped protrusion.
Figure 11B:
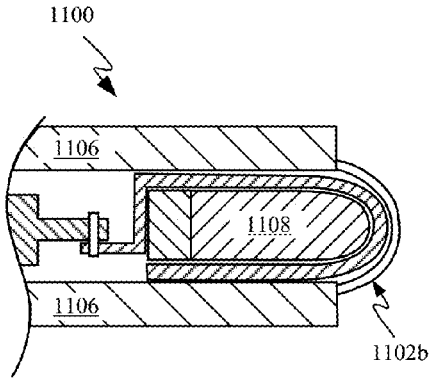

FIGS. 11A-11B show multiple views of a connector plug 1100 similar to the embodiments depicted in FIGS. 9A-10B. In particular, FIG. 11A shows how connector plug 1100 has a pill-shaped protrusion that includes four electrical contacts 1102 and can be packaged with circuitry allowing for plug 1100 to be electrically coupled with receptacle connector 1152 of electronic device 1150 in either of two orientations. Plug 1100 can also include insulating material 1104 disposed between each electrical contacts 1102, which are operable to electrically isolate each of electrical contacts 1102 from each other. Similarly, receptacle connector 1154 includes an insulating material pattern corresponding to the arrangement of insulating material 1104. Both receptacle connector 1152 and plug 1100 can include magnets for facilitating a robust connection between connector plug 1100 and receptacle connector 1152. As described above, the magnets can be arranged in a complementary array configured to facilitate precise alignment of connector plug 1100 with receptacle connector 1152. In some embodiments, the pill-shaped protrusion of connector plug 1100 can be configured to extend and retract when approaching and drawing away from receptacle connector 1152. This can be carried out in many ways, including ways similar to those depicted in FIGS. 10A-10B.

FIG. 11B shows an example of how a magnetic connector similar to the one depicted in FIGS. 10A-10B can be used to provide a magnet and electrical connector behind electrical connector 1102*b*. Such a configuration beneficially allows the retraction of magnet 1108 away from electrical connector 1102*b* when the connector is not in use. Such a configuration would reduce the likelihood of magnet 1108 adversely affecting other magnetically sensitive components when connector 1100 is not in active use. This configuration could also prevent connector plug 1100 from inadvertently becoming electrically coupled with another device that doesn't include magnetically attractable material sufficient to attract magnet 1108.

The various aspects, embodiments, implementations or features of the described embodiments can be used separately or in any combination. Various aspects of the described embodiments can be implemented by software, hardware or a combination of hardware and software.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A magnetically actuated connector, comprising:

a connector housing defining a channel;

a floating contact disposed within the channel, the floating contact comprising an exterior portion formed of electrically conductive material and an interior portion including a magnet, wherein the floating contact including the electrically conductive material and the magnet is configured to follow a linear path between a first position and a second position within the connector housing in response to a magnetic force; and a flexible circuit including a flexible attachment feature, the flexible attachment feature being electrically coupled to the floating contact and being configured to accommodate movement of the floating contact between the first position and the second position.

2. The magnetically actuated connector as recited in claim 1, wherein the magnetically actuated connector includes multiple floating contacts and the flexible circuit includes multiple flexible attachment features.

3. The magnetically actuated connector as recited in claim 2, further comprising circuitry configured to receive a ground signal through a first floating contact, power through a second floating contact and data through a third floating contact.

4. The magnetically actuated connector as recited in claim 1, wherein the floating contact remains in the second position when the magnetically actuated connector is in use.

5. The magnetically actuated connector as recited in claim 4, wherein interior surfaces that define the channel guide the floating contact between the first and second positions.

6. The magnetically actuated connector as recited in claim 4, wherein in the first position the floating contact is recessed below an exterior surface defined by the connector housing and in the second position the floating contacts are substantially flush with the exterior surface of the connector housing.

7. The magnetically actuated connector as recited in claim 1, wherein the exterior portion of the floating contact comprises:

an electrically conductive shell defining an opening; and a magnetic shunt covering the opening and cooperating with the electrically conductive shell to define the interior portion.

8. The magnetically actuated connector as recited in claim 7, wherein the magnetic shunt redirects a portion of a magnetic field emitted by the magnet towards an exterior surface of an accessory device associated with the magnetically actuated connector.

9. The magnetically actuated connector as recited in claim 1, wherein the flexible attachment feature comprises an inner ring and an outer ring.

10. The magnetically actuated connector as recited in claim 1, wherein the floating contact is soldered to a first side of the flexible circuit, the first side being opposite a second side and wherein the magnetically actuated connector further comprises a magnetically attractable substrate coupled with the second side of the flexible circuit.

11. The magnetically actuated connector as recited in claim 10, wherein a magnetic attraction between the magnet and the magnetically attractable substrate moves the floating contact from the second position to the first position when the magnetic force is removed.

12. The magnetically actuated connector as recited in claim 1, wherein the flexible circuit electrically couples the floating contact with one or more operational components disposed within an associated electronic accessory device.

13. The magnetically actuated connector as recited in claim 1, wherein the flexible circuit comprises a flexible printed circuit board, the flexible printed circuit board comprising electrically conductive pathways arranged on a polymeric substrate.

14. An accessory device, comprising:

a device housing; and a magnetically actuated connector arranged along an exterior surface of the device housing, the magnetically actuated connector comprising:

a floating contact having an exterior portion formed of electrically conductive material and an interior portion including a magnet; and a flexible circuit that includes a flexible attachment feature including an inner portion and an outer portion that are concentric, the flexible attachment feature being soldered to the floating contact and being configured to accommodate movement of the floating contact between a first position and a second position.

15. The accessory device as recited in claim 14, further comprising:

a protective cover defining a channel therethrough that defines a pathway along which the floating contact moves between the first position and the second position.

16. The accessory device as recited in claim 15, wherein the channel allows an exterior contact surface of the floating contact to be arranged along an exterior surface of the protective cover when the floating contact is in the second position.

17. The accessory device as recited in claim 15, wherein the floating contacts further comprises a magnetic shunt redirecting a magnetic field emitted by the magnet towards an exterior surface of the magnetically actuated connector.

18. An accessory device, comprising:

a device housing; and a magnetically actuated connector arranged along an exterior surface of the device housing, the magnetically actuated connector comprising:

an electrical contact having an exterior portion formed at least in part of electrically conductive material and an interior portion that includes a magnet, and an electrically conductive pathway having an inner portion and an outer portion that are concentric, the electrically conductive pathway electrically coupling the electrical contact to circuitry of the accessory device and being configured to accommodate movement of the electrical contact between a first position and a second position.

19. The accessory device as recited in claim 18, wherein the electrically conductive pathway comprises a flexible circuit that is coupled with a magnetically attractable substrate.

20. The accessory device as recited in claim 19, wherein the flexible circuit accommodates the movement of the floating contact from the first position to the second position by deforming away from the magnetically attractable substrate.

21. The accessory device as recited in claim 18, wherein the magnetically actuated connector comprises a plurality of electrical contacts and wherein the magnetically actuated connector can be attached to an electronic device in two or more orientations.

* * * * *